US006002321A

United States Patent [19]

Laine

[11] Patent Number: 6,002,321

[45] Date of Patent: Dec. 14, 1999

[54] MINE-CLEARING COIL AND DEVICE USING SAME

[75] Inventor: Loïc Laine, Saint Doulchard, France

[73] Assignee: Giat Industries, France

[21] Appl. No.: 09/000,180

[22] PCT Filed: Jun. 19, 1997

[86] PCT No.: PCT/FR97/01105

§ 371 Date: Mar. 17, 1998

§ 102(e) Date: Mar. 17, 1998

[87] PCT Pub. No.: WO97/48965

PCT Pub. Date: Dec. 24, 1997

[30] Foreign Application Priority Data

Jun. 17, 1996 [FR] France ..... 96/07644

[51] Int. Cl.[6] ..... H01F 27/24

[52] U.S. Cl. ..... 336/212; 336/216; 336/217; 336/221; 336/234; 102/402; 89/1.13

[58] Field of Search ..... 102/402; 89/1.13; 336/221, 90, 234, 216, 217, 212

[56] References Cited

U.S. PATENT DOCUMENTS

| | | | |
|---|---|---|---|
| 3,417,382 | 12/1968 | Snyder et al. | 336/221 |
| 3,707,913 | 1/1973 | Lee | 102/18 |
| 4,993,325 | 2/1991 | Slone, Jr. et al. | 102/402 |
| 5,001,485 | 3/1991 | Jones | 342/13 |
| 5,458,063 | 10/1995 | Laine et al. | 102/402 |

FOREIGN PATENT DOCUMENTS

| | | |
|---|---|---|
| 0574967 | 12/1993 | European Pat. Off. . |
| 2701105 | 8/1994 | France . |
| 3424231 | 1/1986 | Germany . |
| 3444037 | 6/1986 | Germany . |

*Primary Examiner*—Michael L. Gellner
*Assistant Examiner*—Tuyen Nguyen
*Attorney, Agent, or Firm*—Parkhurst & Wendel, L.L.P

[57] ABSTRACT

A demining coil to be fastened to a demining vehicle, which coil comprises a magnetic core and wherein the ratio of length to the largest transversal dimension of the core of the coil is greater than or equal to 4. The core of the coil may be fluted in shape and/or magnetically laminated. A demining device utilizes a plurality of demining coils spaced in different directions to maximize the area of detection.

9 Claims, 10 Drawing Sheets

MINE-CLEARING COIL AND DEVICE USING SAME

Figure 1A:
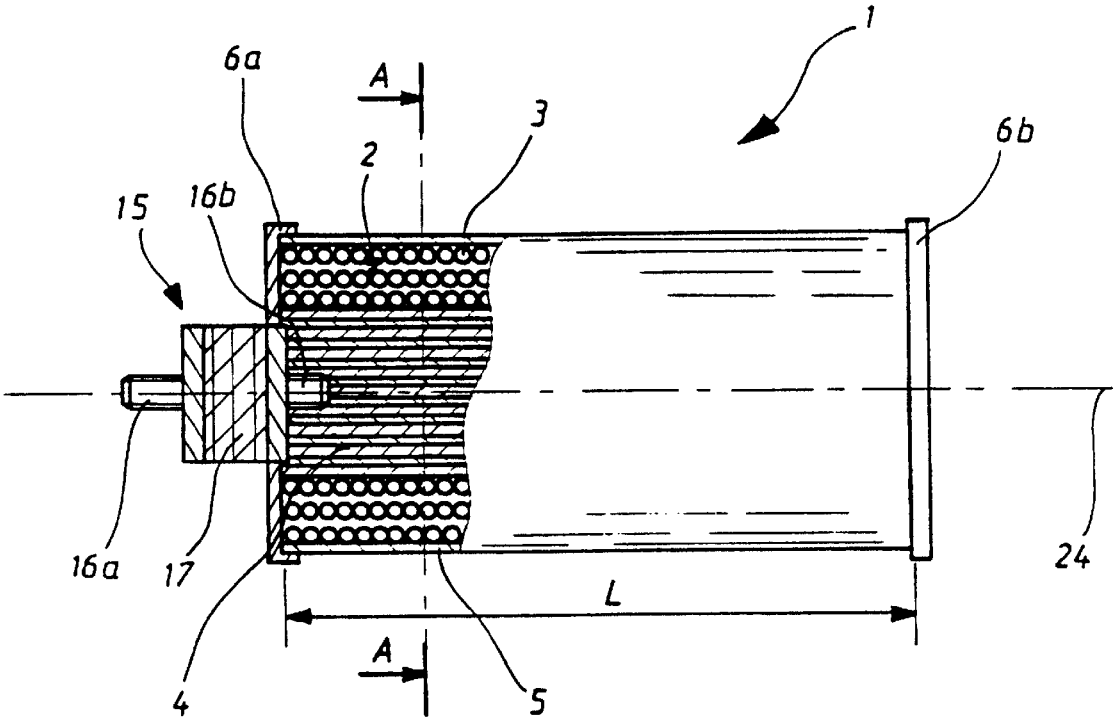

The technical scope of the present invention is that of coils used in demining operations.

Demining devices are known notably by patents DE3444037 and FR2701105 which implement at least one induction coil powered by an electric circuit.

Known devices generally used substantially plane coils with no core.

Indeed, this technology enables coils to be placed directly on a tank glacis thus limiting the disturbances to the magnetic field that the mass of the tank could generate.

However, these coils have one main drawback in that they are very heavy (the usual mass of a demining coil is of 80 kg), and the field generated remains of a relatively small amplitude (around 5 micro tesla at 5 m).

Moreover, the magnetic field generated is essentially oriented along a single axis (the axis of the coil) thereby reducing the effectiveness of the demining device.

A first aim of the invention is to propose a demining coil whose size is reduced and whose effectiveness is improved with respect to known coils.

A further aim of the invention is to propose a demining device implementing one or several of these demining coils, a device whose effectiveness is greater than that of known demining devices.

Thus, the subject of the invention is a demining coil intended in particular to be made integral with a demining vehicle, a coil characterized in that it incorporates a magnetic laminated or fluted core to restrict the eddy currents and in that the ratio of length to the largest transversal dimension of the core of the coil is greater than or equal to 4.

The constitutive material of the magnetic core will preferably have a relative permeability greater than or equal to 100 and a saturation induction greater than or equal to 2 tesla.

The demining coil can be surrounded by a protective casing made of a non-magnetic and non-conductive material.

According to another characteristic of the invention, the coil can incorporate a linking means intended to enable its fastening onto a support placed at a front part of a demining vehicle, the linking means being formed so as to allow an angular displacement of the coil axis with respect to the support.

Thus, the linking means can incorporate a base having at least two fastening systems separated by a part made of a flexible synthetic material.

According to another embodiment, the linking means can incorporate at least two elastic shims, arranged between the coil and the protective casing, shims which ensure flexible positioning of the coil substantially level with the casing axis.

According to another embodiment, the linking means can incorporate at least three concentric rings, pivots being provided between a middle ring and the two other rings, pivots positioned so as to allow the inner ring carrying the coil to pivot in along at least two orthogonal axes.

A further subject of the invention is a demining device implementing at least three coils and characterized in that the coils are fastened onto a support placed on a front part of the demining vehicle, the coil axes being spaced so as to form two by two at least two non parallel planes.

According to another embodiment, the coils are fastened onto a support placed on a front part of the demining vehicle, and the coil axes are spaced along at least two different directions.

The coil axes can be spaced along at least three different directions.

Figure 1B:
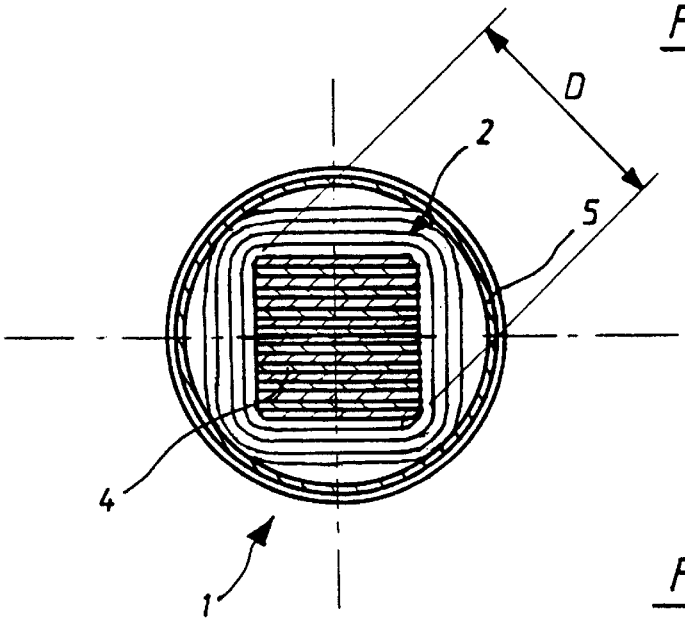

The invention will be better understood after reading the following description of the different embodiments, description made with reference to the annexed drawings in which:

FIG. 1*a* shows a longitudinal section view of a demining coil according to a first embodiment of the invention, FIG. 1*b* is a transversal view of this coil along the plane referenced AA in FIG. 1*a,*

Figure 2A:
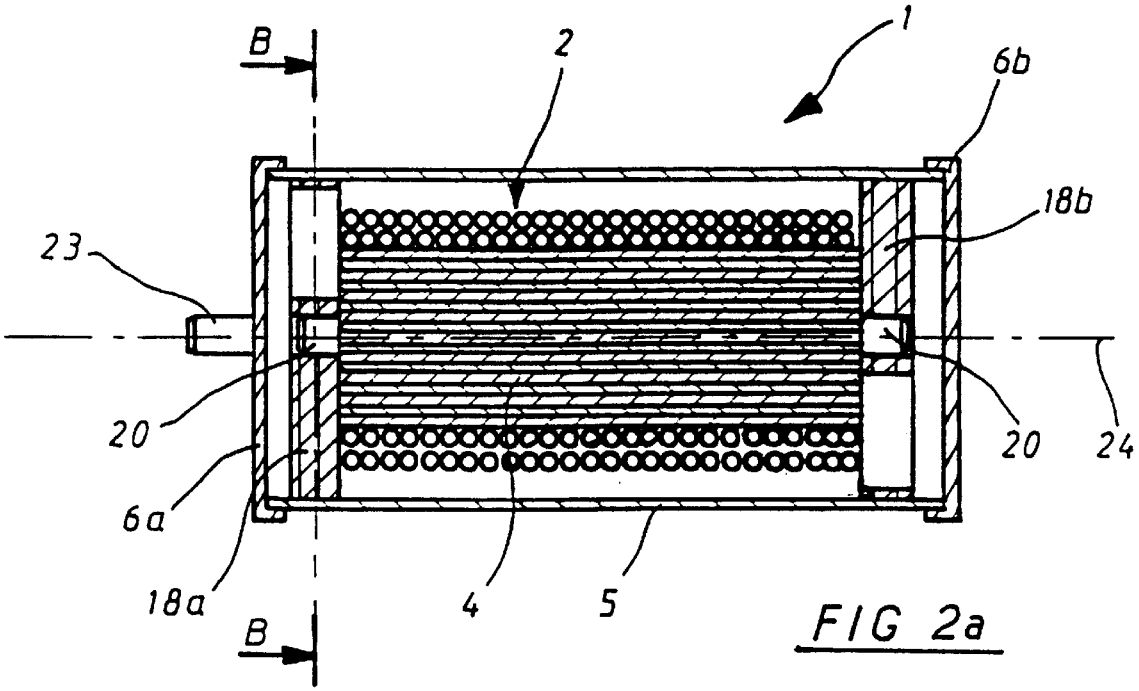
Figure 2B:
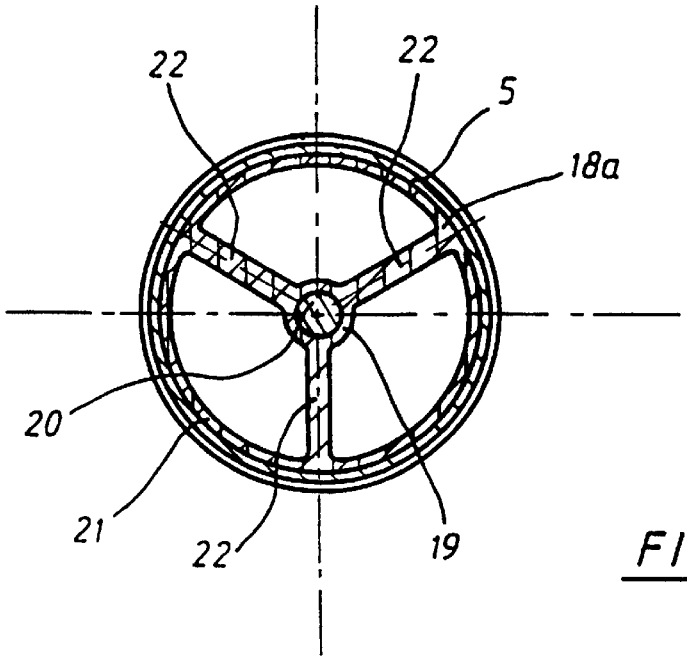

FIG. 2*a* shows a longitudinal section view of a coil according to a second embodiment of the invention, FIG. 2*b* is a transversal section view of this coil along the plane referenced BB in FIG. 2*a,*

Figure 3A:
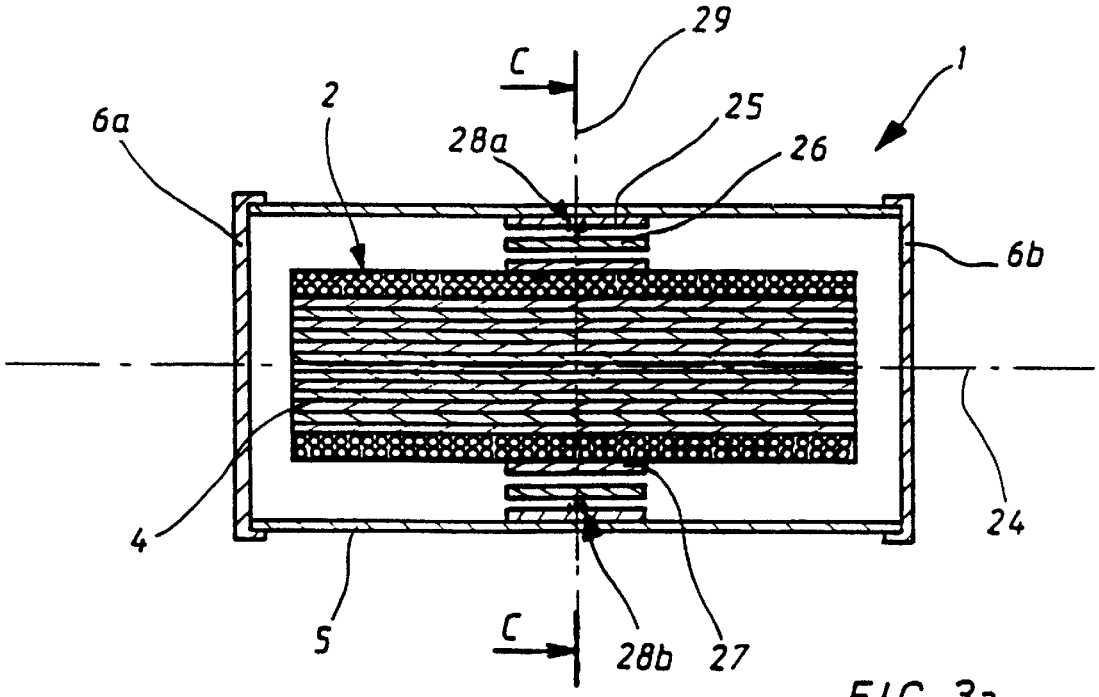
Figure 3B:
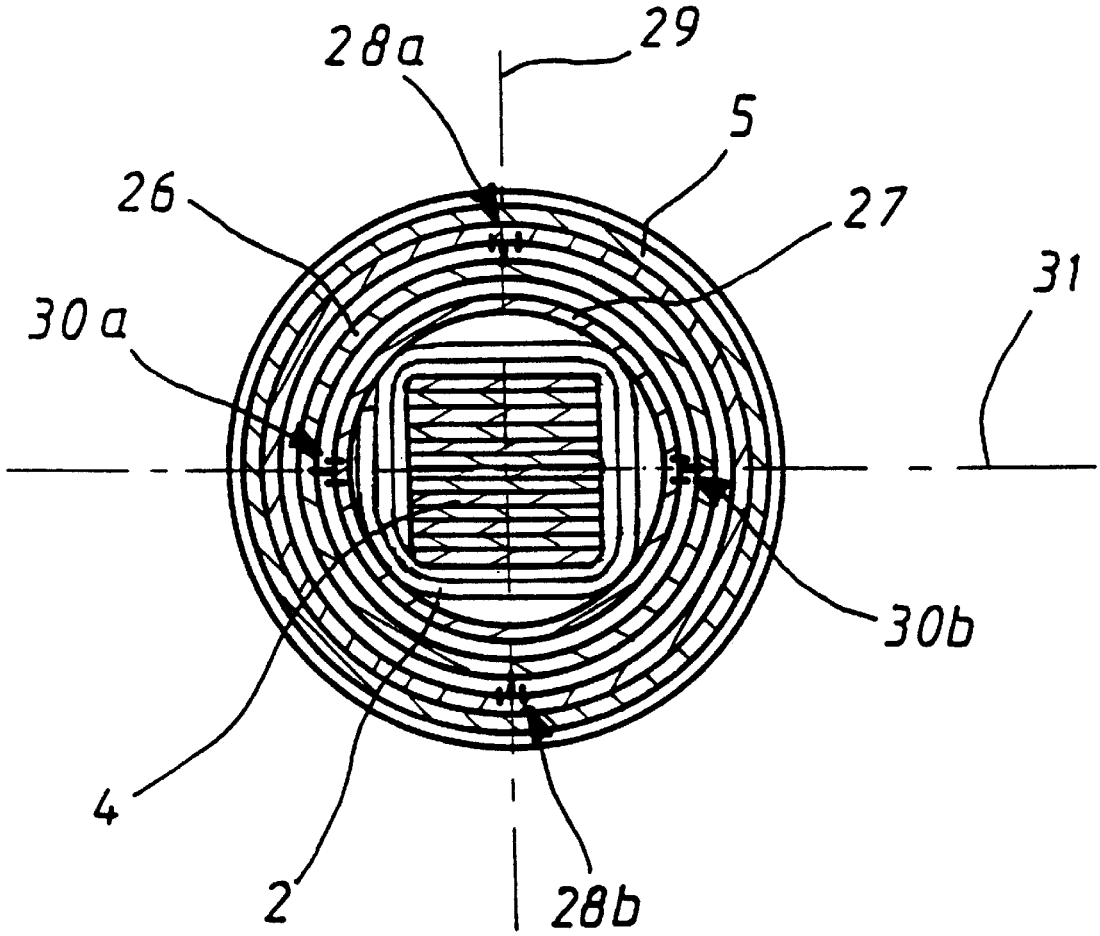

FIG. 3*a* shows a longitudinal section view of a according to a third embodiment of the invention, FIG. 3*b* is a transversal section view of this coil along plane referenced CC in FIG. 3*a,*

Figure 4:
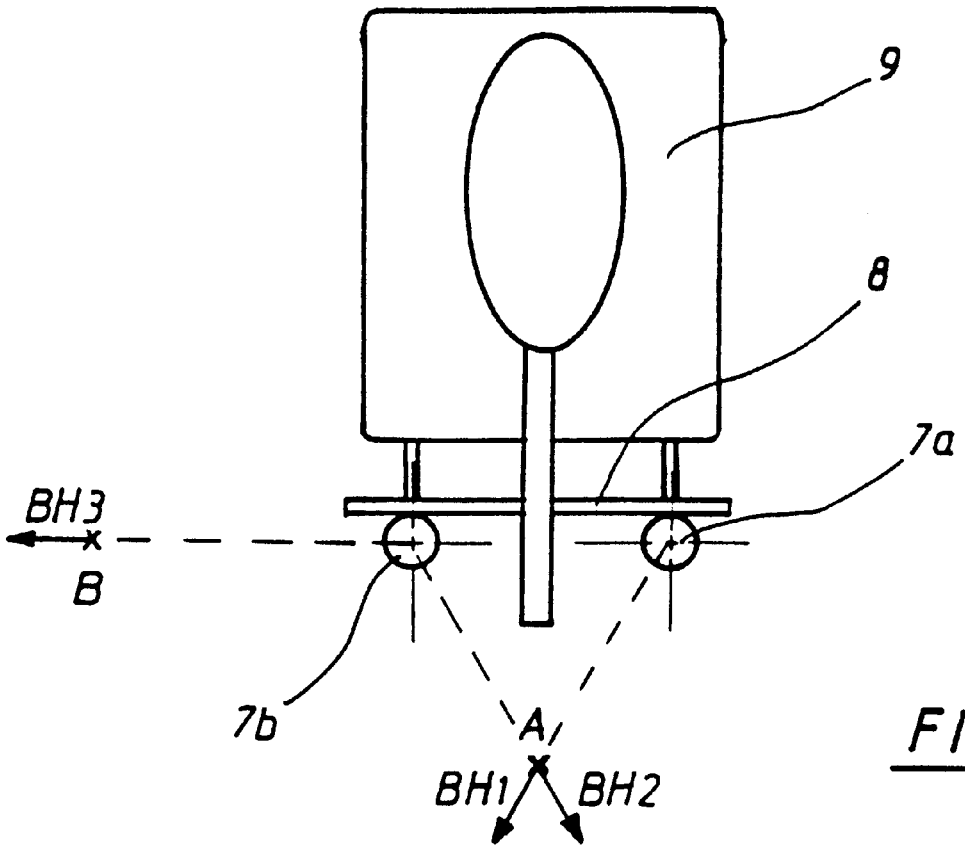
Figure 4A:
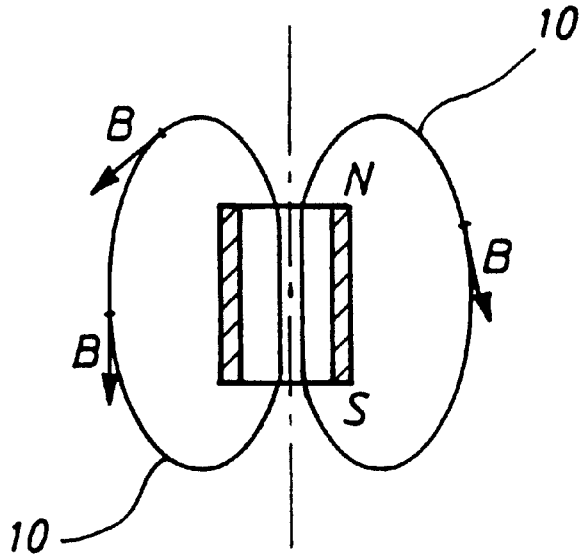
Figure 5:
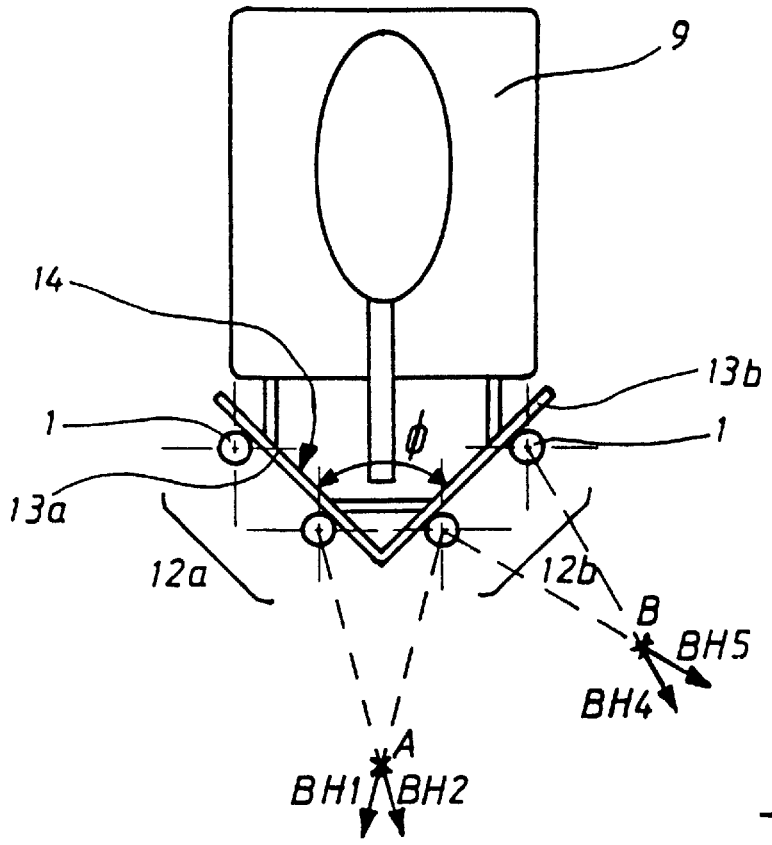
Figure 6:
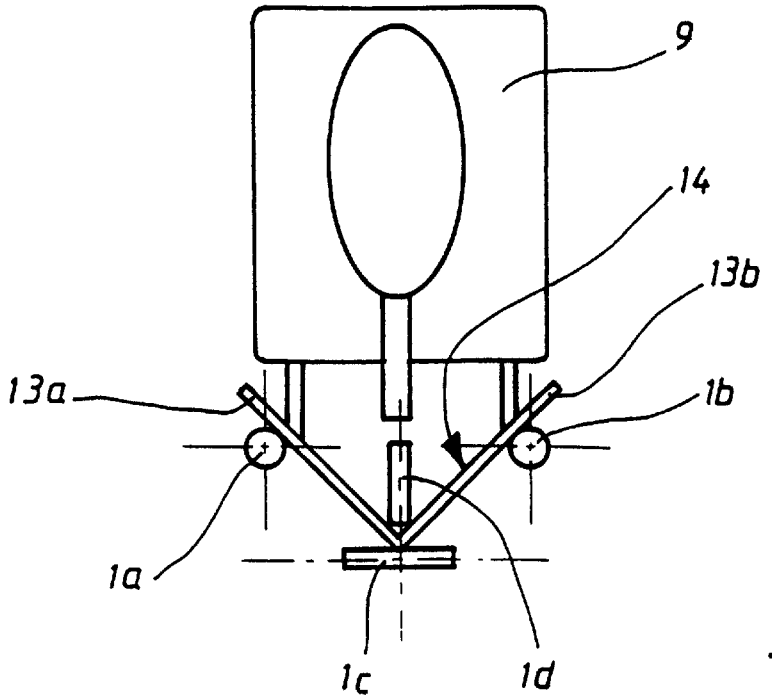
Figure 7A:
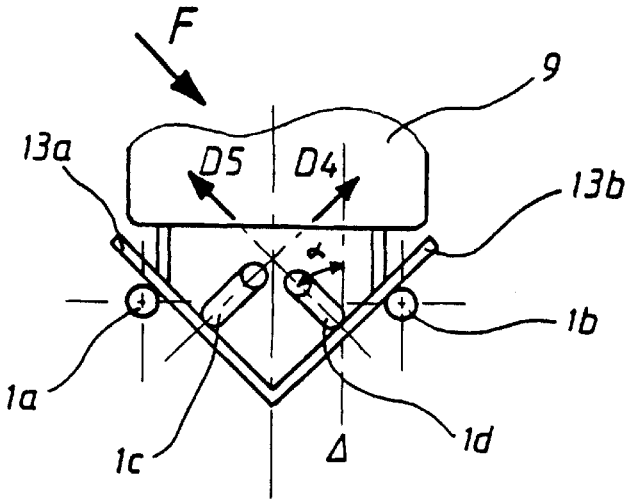
Figure 7B:
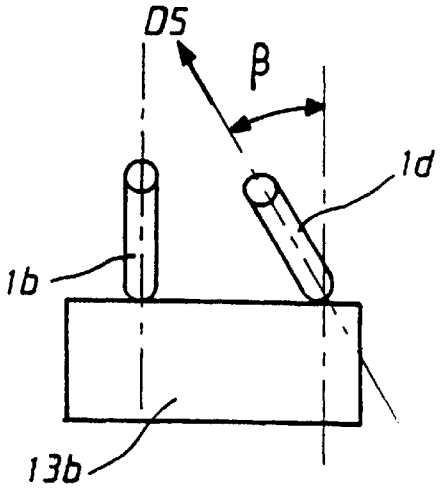

FIG. 4 schematically shows a demining device according to prior art,

FIG. 4*a* schematically shows the orientation of the lines of flux around an induction coil, FIG. 5 schematically shows a demining device according to a first embodiment of the invention, FIG. 6 schematically shows a demining device according to a second embodiment of the invention, FIGS. 7*a* and 7*b* schematically show a demining device according to a fourth embodiment of the invention, FIG. 7*a* being a view of the device along direction referenced F in FIG. 7*a,*

Figure 8:
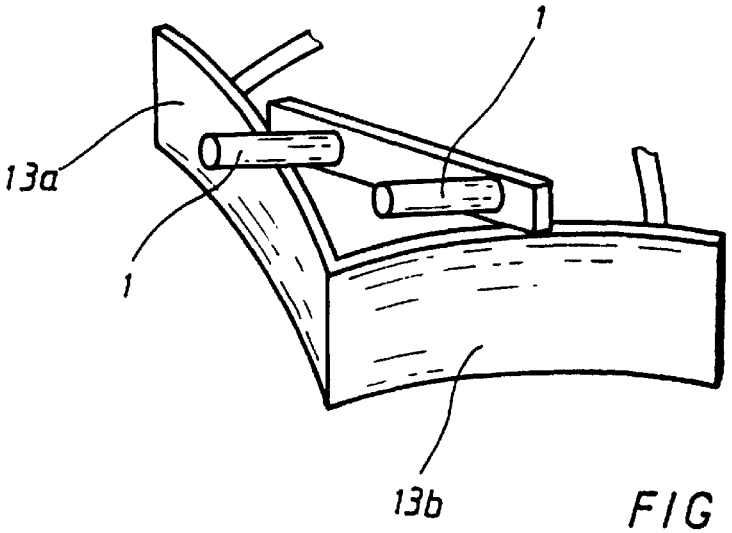

FIG. 8 schematically shows a demining device according to a variant of the invention.

Figure 9A:
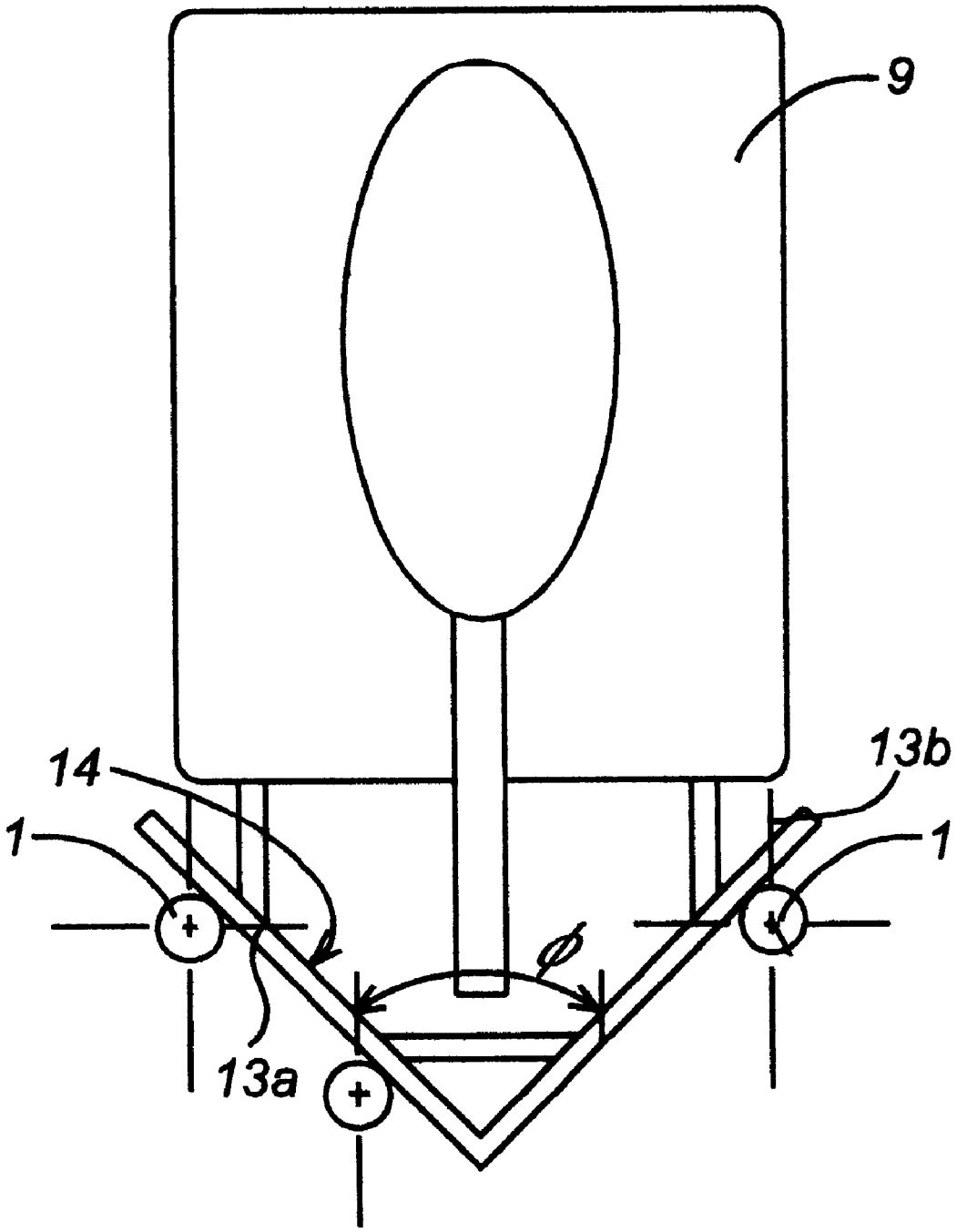
Figure 9B:
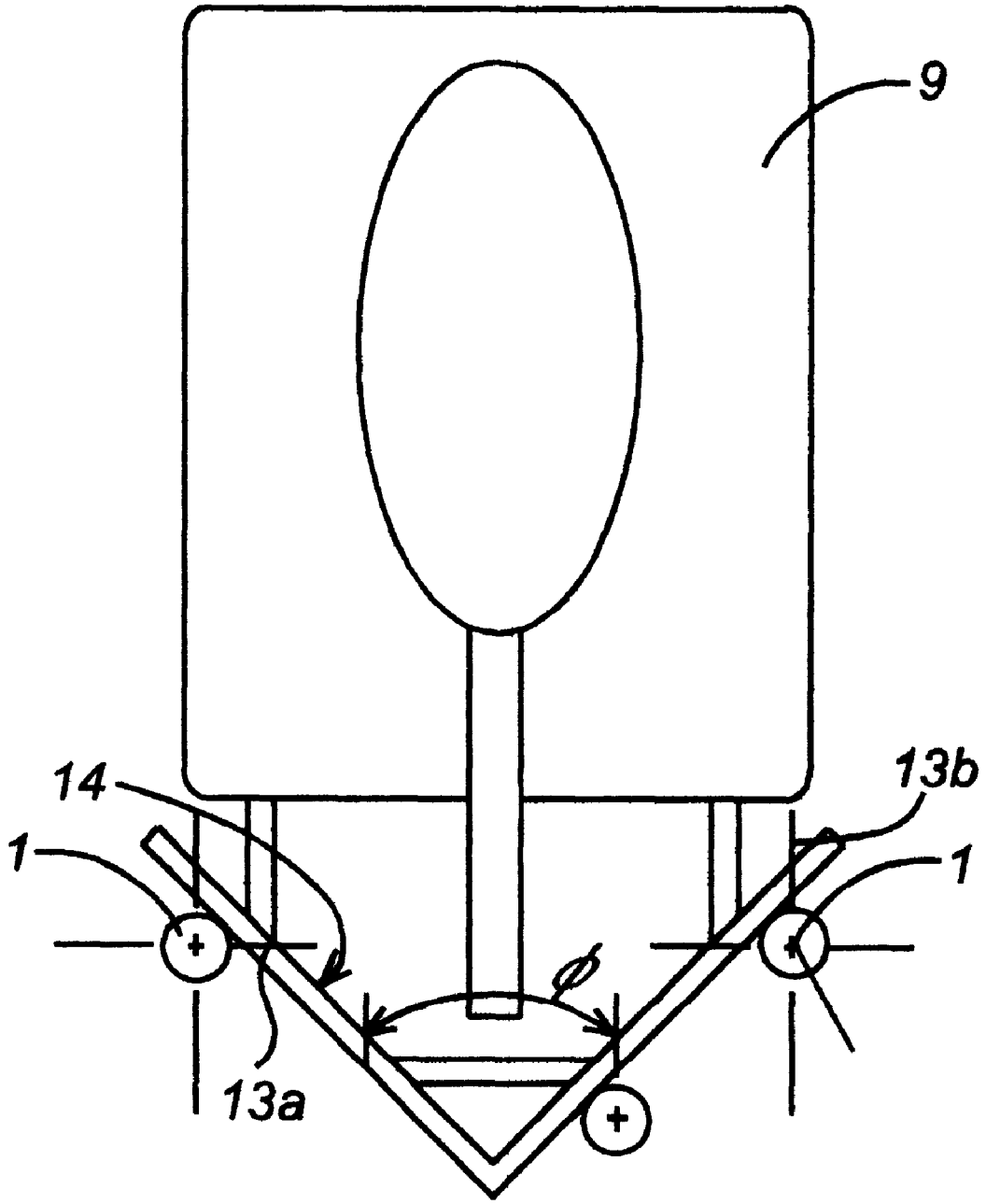
Figure 9C:
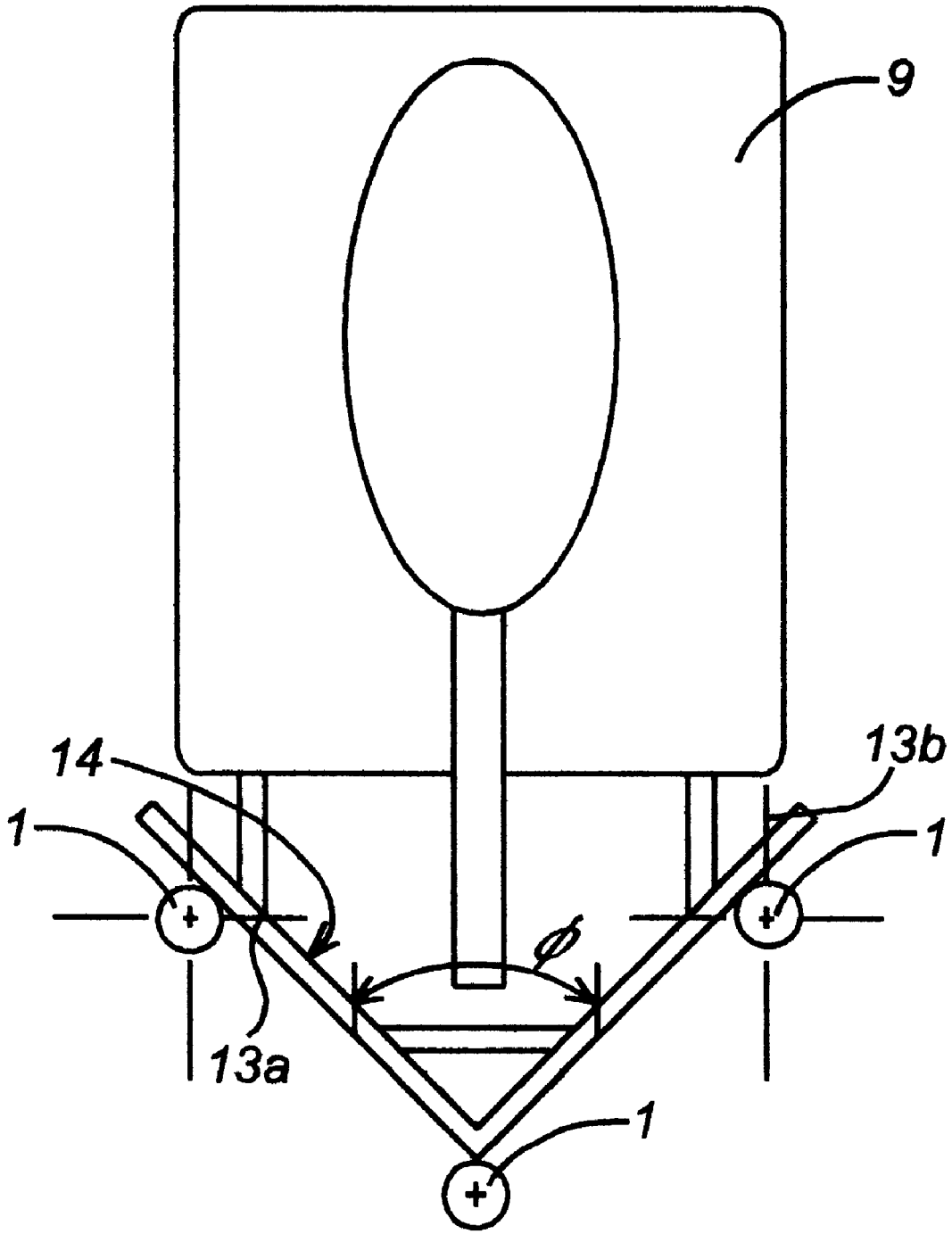

FIGS. 9*a*–9*c* depict variations of a three coil demining device as discussed at page 9.

With reference to FIG. 9, a demining coil 1 according to the invention is intended to be fastened to a front part of a demining vehicle (not shown).

This coil comprises a wound spool 2 of conductive wire 3, spool comprising a certain number of concentric layers. This wound spool is made around a magnetic core 4. The wound spool is connected by connections, not shown, to control electronics, for example of the type described in patent FR2701105.

Core 4 is of a parallelepipedic shape selected for its manufacturability. It is laminated and is formed of a stack of soft iron sheets insulated from one another by a layer of oxide. The different oxide layers act as an electric insulator which restricts the actions of the eddy currents.

By way of a variant, a core comprising longitudinal fluting, which penetrates radially into the core, could be used. This fluting also restricts the eddy currents.

The material for the sheets will be selected such that it has a relative permeability $\mu r$ greater than or equal to 100. This limit value is sufficient as the magnetic induction created by the coil at 4 m no longer increases with $\mu r$ when the latter exceeds 100.

Saturation induction of the material of the core (maximum magnetic induction allowed by the material) must also be as high as possible so as to limit the non-linearities of the magnetic induction which is created according to the current. Efficiency is thus improved.

In practical terms, saturation induction will be chosen greater than or equal to 2 tesla.

By way of example, a standard soft iron core can be used whose $\mu r$ is around 1000 and the saturation induction is of 2 tesla. Wire 3 of the wound spool will be a copper wire. The length of the wire and thus the number of concentric layers will be selected according to the performances required for the coil.

The coil is sized such that its core has a ratio of its length L to its widest transversal dimension (here the diagonal of the square section) greater than 4.

Such an arrangement enables the efficiency, mass and bulk constraints of the coil to be optimized.

Indeed, the field projected from out of the coil will be all the greater in that the coil core is long, this is due to the fact that the lines of flux close up between the two North (N) and South (S) poles of a coil (see FIG. 4*a*). They close up much further from the coil if the latter, or its core, is long.

In parallel, the value of the self-inducting coil must remain relatively low so that it is possible to inject current in the latter. However, the value of the self-inducting coil increases with its diameter.

Lastly, the mass of the coil is proportional to its volume.

The essential parameter in designing an efficient coil is thus the L/D (length to diameter or length to widest transversal dimension for a parallelepipedic core) ratio.

The coil is arranged inside a protective casing 5 made of a non-magnetic and non-conducting material (for example, made of a plastic or filament wound material) and closed by lids 6*a*, 6*b*. This casing protects the coil against external aggressions.

At one of its ends, this coil carried linking means 15 which are intended to enable its fastening onto a support placed at a front part of the demining vehicle.

These linking means are formed by a base having at least two fastening systems 16*a*, 16*b* (here threaded rods) separated by a part 17 made of a flexible synthetic material (for example, rubber).

Each threaded rod 16*a*, 16*b* is integral with a metallic plate on which the middle part 17 is duplicate moulded.

The linking means are flexible and allow an angular displacement of axis 24 of coil 1 with respect to the support.

Thus, when the vehicle is moving, the coil is subjected to vibrations which randomly modify the spatial components of the magnetic field generated.

As a result, demining efficiency is improved.

It is naturally possible to fasten the coil according to the invention onto a vehicle by means of rigid linking means.

By way of example, a coil according to the invention, comprising a wound spool of 150 m of wire and having a wider section dimension (D) by 80 mm for a length L of 550 mm, has a mass of 18 kg. At a given point, it creates a magnetic field of an intensity which is double that generated by an air coil of a known type having the same number of wraps and whose mass is of 35 kg.

With an equivalent electrical voltage, 4 air coils of this type with create a field of 6 micro teslas at 5 m, and 4 core coils will generate a field of 15 micro teslas.

FIGS. 2*a* and 2*b* show a second embodiment of a coil according to the invention.

This embodiment differs from the previous one in that core carrying the wound spool of wire 2 is positioned substantially coaxially to casing 5 by two elastic shims 18*a* and 18*b* which thus form the flexible linking means of the coil.

Shims 18*a*, 18*b* are made, for example, of rubber. Each shim incorporates a ring-shaped central part 19 positioned at a cylindrical rod 20 integral with the laminated core 4.

Each end of core 4 carries such a rod 20 which can be made of a plastic (non-magnetic) material and fastened to core 4 by threading, for example.

Central part 19 of the shim is connected to a peripheral part 21 by three arms 22. The thickness and shape of arms 22 are determined such as to give the required flexibility to the link.

Peripheral part 21 of each shim is adjusted to the inner surface of casing 5.

Shims 18*a*, 18*b* are fastened to rods 20 and to casing 5, for example by bonding.

Casing 5 is itself fastened to the vehicle by means of a threaded rod 23 integral with lid 6*a*.

The advantage of this embodiment is that coil 1 is suspended by its two ends at axis 24 of protective casing 5. More complicated vibratory movements can therefore be imparted to it than are allowed by the previous embodiment.

This results in even more random variation of the magnetic field generated and thus greater efficiency.

Moreover, the flexible mode of fastening is protected by casing 5.

It is naturally possible to provide variant embodiments and to modify, for example, the shapes of the shims, the number of arms, the material of the shims. It is also possible to provide reinforcement inserts at the central and peripheral parts. It is possible to provide a third shim arranged substantially in the middle of the coil.

It is lastly possible to combine the embodiments in FIGS. 1 and 2 by associating a coil suspended by shims 18*a*, 18*b* and whose casing is fastened to the vehicle by flexible linking means 16, 17.

FIGS. 3*a* and 3*b* show a third embodiment of a coil according to the invention.

According to this embodiment, the coil is linked to casing 5 (which enables its fastening on the carrier vehicle) by means of a compass assembly which comprises an outer ring 25, a middle ring 26 and an inner ring 27. Middle ring 26 is linked to outer ring 25 by two pivots 28*a*, 28*b* (shown schematically) which allow the middle ring to revolve with respect to the outer ring around an axis 29 perpendicular to the casing axis.

The middle ring 26 is linked to the inner ring 27 by two other pivots 30*a*, 30*b* (shown schematically) which allow inner ring 27 to revolve with respect to middle ring 26 around an axis 31 perpendicular to the casing axis and to axis 29.

The coil is integral with inner ring 27.

As a result of this assembly, axis 24 of the coil is able to pivot around axes 29 and 31.

When the carrier vehicle is moving, the coil axis constantly changes its orientation thereby making the magnetic field vary at random thus improving demining efficiency.

Limit stops can be provided to fix maximum values for the angular displacement of axis 24.

FIG. 4 shows a demining device according to prior art.

This device incorporates two coils 7*a*, 7*b* arranged on a bar 8 integral with a front part of a vehicle 9.

The coils are arranged such that the axes are substantially vertical (here, they are perpendicular to the plane of the figure).

In a known manner, a coil generates a magnetic field whose vector is tangent to equipotential lines which are substantially parallel to the coil axis inside the latter and which close up outside the coil.

FIG. 4*a* thus schematizes (reminder) a longitudinal section of a coil 11 with lines of flux 10 which it has created and certain magnetic field vectors B positioned on the lines of flux.

Thus, the field vectors are not perfectly parallel to the axis of the coil outside the latter.

As the deminer coils have substantially vertical axes, they generate a magnetic field to the front of the demining vehicle which has a vertical component and a horizontal component.

The field seen from a point A located to the front of the deminer is a composition of the field created by the two coils. This field thus possesses one vertical and two horizontal components (shown by notes BH1 and BH2).

On the contrary, the field seen from a point B located laterally to the deminer only shows a single horizontal component (BH3), which, in practical terms, corresponds to the action of the nearest coil only (the attenuation of the field generated by a coil being proportional to the cube of the distance).

As a result, efficiency is reduced for mines positioned laterally to the deminer.

With respect to FIG. 5, a demining device according to a first embodiment of the invention incorporates four coils 1 of the type described with reference to FIGS 1*a* and 1*b*. These coils have substantially vertical axes and are arranged in two pairs 12*a*, 12*b*.

Each pair of coils is integral with a wing 13*a*, 13*b* of a support 14 integral with vehicle 9. Wings 13*a* and 13*b* are not coplanar and thus form an angle $\phi$.

From a geometric point of view the coil axes of each pair can be said to form a plane which corresponds to a wing 13*a* or 13*b*, and the two planes 13*a*, 13*b* formed by the coils are not parallel.

A clearing blade, which is usually used on demining vehicles, will advantageously be adopted as support 14.

Such an arrangement considerably improves the efficiency of the demining device.

Indeed, if a point A positioned to the front of vehicle 9 sees a magnetic field having two horizontal components BH1, BH2, a point B positioned laterally to the vehicle also sees a magnetic field having two horizontal components BH4 and BH5. Each point thus sees two different coils located at distances which are around the same, these coils generate lines of flux having slightly different shapes, their actions are combined.

By way of a variant, it is naturally possible to use only three coils FIG. 9*a* as shown, two positioned on wing 13*a* and the other on wing 13*b*, FIG. 9*b* shows the reverse or as in FIG. 9*c* alternatively one on each wing and the third at the intersection of the two wings 13*a*, 13*b*.

FIG. 6 shows another embodiment of the demining device according to the invention in which support 14 also incorporates two lateral wings 13*a* and 13*b*, which form an angle.

So as to improve the spread of the magnetic field following three orthogonal components Bx, By and Bz, two coils 1*a* and 1*b* are oriented with their axis vertical, two coils 1*c* and 1*d* have their axis horizontal, and the axis of coil 1*c* is perpendicular to that of coil 1*d*.

At ground level, each coil generates a magnetic field whose maximum intensity component is substantially that which is parallel to the coil axis, with the configuration in FIG. 6 a resultant magnetic field is sure to be generated which incorporates components following the three orthogonal directions.

This results in improved demining efficiency.

FIGS. 7*a* and 7*b* show another embodiment of the invention in which, so as to spread the intensity of the magnetic field following three orthogonal directions two coils 1*a* and 1*b* having vertical axes and two coils 1*c* and 1*d*, whose respective axes D4 and D5 form an angle, both with the vertical (angle $\beta$ visible in FIG. 7*b*) and with the direction $\Delta$ in which the vehicle advances ($\Delta$ angle visible in FIG. 7*a*), have been positioned on support 14.

Suitable adjustment of angles and $\beta$ enable a magnetic field to be generated with a given intensity following each of the three orthogonal directions.

By way of a variant, the four coils can also be fastened to a plane support, the double inclination and $\beta$ ensuring the presence of three components of the magnetic field for each point in the space around the vehicle.

It is also possible to provide individual adjustment means for the angles of each of the coils. In this case each of the components of the magnetic field generated can be adjusted accurately (by using nomographs). Adjustment can possibly be controlled manually or automatically from the demining vehicle so as to adapt demining to a particular configuration of the ground.

All the embodiments of the invention shown in FIGS. 5 to 7 can be implemented with coils fastened to support 14 in a rigid manner.

They can also be implemented with coils incorporating flexible linking means such as those described with reference to FIGS. 1, 2, and 3.

Flexible linking means can, for example, enable only coils having practically the same orientation to be used.

FIG. 8, which shows a support formed by a clearance blade, incorporating two wings 13*a*, 13*b* on which coils 1 with parallel axes are fastened, can be considered in this manner. The coils are linked to the support by flexible linking means of the type, for example, shown in FIGS. 1, 2, or 3.

In this case, the variation in components of the field given by the flexible link is enough to ensure demining efficiency.

I claim:

1. A demining coil for a demining vehicle comprising:

a magnetic core having at least one of a magnetically laminated and a longitudinally fluted structure:

a spool of wire wound around said magnetic core;

said magnetic core having a ratio of length to its widest transverse dimension greater than 4 to restrict a value of eddy currents;

a linking means to permit fastening of the demining coil to a support located on a front of a demining vehicle, said linking means permitting angular displacement of an axis of the demining coil with respect to the support.

2. A demining coil according to claim 1 further comprising a protective casing comprising a non-magnetic, non-conductive material that surrounds the demining coil.

3. A demining coil according to claim 1 wherein said linking means comprises a base having at least two fastening systems separated by a part comprising a flexible synthetic material.

4. A demining coil according to claim 2 wherein said linking means comprises at least two elastic shims located between the demining coil and said protective casing, said shims providing flexible positioning of the demining coil at a position substantially level with an axis of said protective casing.

5. A demining coil according to claim 1 wherein said linking means further comprises:

at least three concentric rings forming an outer ring, a middle ring and an inner ring, a plurality of pivots located between the middle ring and the inner and outer rings, said pivots permitting the inner ring surrounding said spool of wire to pivot in at least two orthogonal axes.

6. A demining device comprising at least three demining coils according to claim 1, wherein said demining coils are fastened onto a support on a front of a demining vehicle; and said demining coils having axes oriented so that two pairs of coils selected from the three demining coils form two non-parallel planes.

7. A demining coil according to claim 1 wherein said magnetic core comprises a material having a relative permeability greater than or equal to 100; and wherein said magnetic core comprises a material having a saturation induction greater than or equal to 2 tesla.

8. A demining device comprising at least three demining coils according to claim 7 wherein said demining coils are fastened onto a support on a front of a demining vehicle.

9. A demining device according to claim 8 wherein said demining coils having axes oriented in at least two different directions.

* * * * *

UNITED STATES PATENT AND TRADEMARK OFFICE

CERTIFICATE OF CORRECTION

PATENT NO. : 6,002,321

DATED : December 14, 1999

INVENTOR(S) : Loic LAINE

It is certified that error appears in the above-identified patent and that said Letters Patent is hereby corrected as shown below:

On page 1, column 1, [30] Foreign Application Priority Data, change "Jun. 17, 1996" to --Jun. 19, 1996--.

Signed and Sealed this

Twenty-fifth Day of July, 2000

*Attest:*

*Attesting Officer*

Q. TODD DICKINSON

*Director of Patents and Trademarks*